US006254205B1

(12) United States Patent
Wright et al.

(10) Patent No.: US 6,254,205 B1
(45) Date of Patent: Jul. 3, 2001

(54) RAIL ASSEMBLY WITH HOMING DEVICE AND INTERLOCK

(75) Inventors: Alan R. Wright, Wyoming; Alex Dopp, Grandville, both of MI (US)

(73) Assignee: Thomas Regout USA Inc., Byron Center, MI (US)

( * ) Notice: Subject to any disclaimer, the term of this patent is extended or adjusted under 35 U.S.C. 154(b) by 0 days.

(21) Appl. No.: 09/491,276

(22) Filed: Jan. 26, 2000

Related U.S. Application Data

(60) Provisional application No. 60/118,275, filed on Feb. 2, 1999.

(51) Int. Cl.[7] ..... E05C 7/06

(52) U.S. Cl. ..... 312/217; 312/221

(58) Field of Search ..... 312/107.5, 215, 312/216, 217, 218, 219, 220, 221, 222, 333, 334.44, 334.46

(56) References Cited

U.S. PATENT DOCUMENTS

| | | | |
|---|---|---|---|
| 3,874,755 | 4/1975 | Hegg et al. | 312/221 |
| 3,900,236 | 8/1975 | Goulish et al. | 312/217 |
| 3,909,090 | 9/1975 | Breckner et al. | 312/217 |
| 4,298,236 | 11/1981 | Laroche | 312/215 |
| 4,355,851 | 10/1982 | Slusser | 312/215 |
| 4,768,844 | 9/1988 | Ludwig | 312/221 |
| 4,865,404 | 9/1989 | Harper | 312/221 |
| 4,889,396 | 12/1989 | Mitchell et al. | 312/221 |
| 4,936,640 | 6/1990 | Pratzer | 312/221 |
| 5,040,858 | 8/1991 | Kruse et al. | 312/221 |
| 5,056,877 | 10/1991 | Westwinkel | 312/221 |
| 5,181,781 | 1/1993 | Wojick | 312/334.44 X |
| 5,181,782 | 1/1993 | Wojick | 312/334.44 X |
| 5,240,318 | 8/1993 | Schroder et al. | 312/319.1 |
| 5,352,030 | 10/1994 | Derle et al. | 312/221 |
| 5,411,327 * | 5/1995 | Norton | 312/216 X |
| 5,634,701 * | 6/1997 | Hendrich et al. | 312/221 |

FOREIGN PATENT DOCUMENTS

| | | |
|---|---|---|
| 186677 | 3/1937 | (CH) . |
| 3347540 | 7/1985 | (DE) . |

* cited by examiner

*Primary Examiner*—Peter M. Cuomo
*Assistant Examiner*—James O. Hansen
(74) *Attorney, Agent, or Firm*—Warner Norcross & Judd LLP

(57) ABSTRACT

An integrated interlock and homing device for a rail assembly. The interlock includes a number of stacked locking bars located adjacent to the rails and a separate locking slide mounted adjacent to each rail in alignment with the locking bars. The homing device includes a separate pivot arm mounted to each rail that moves between open and closed positions when the corresponding rail is extended or retracted. The pivot arm includes an actuator pin that operates the corresponding locking slide. When the homing device is opened, the arm and actuator pin move the locking slide into a locked position thereby locking the locking bars and preventing additional rails from being opened. When the homing device is closed, the arm and actuator pin move the locking slide into an unlocked position thereby releasing the locking bars.

37 Claims, 10 Drawing Sheets

RAIL ASSEMBLY WITH HOMING DEVICE AND INTERLOCK

This application claims the benefit of U.S. provisional application Ser. No. 60/118,275, filed Feb. 2, 1999 and entitled RAIL ASSEMBLY WITH HOMING DEVICE AND INTERLOCK.

BACKGROUND OF THE INVENTION

The present invention relates to rail assemblies, and more particularly to a homing device and interlock for a rail assembly.

Telescopic rails, or drawer slides, are widely used for guiding movement of drawers, shelves, and other sliding elements. One common application for telescopic rails is to guide movement of drawers in a lateral filing cabinet. A conventional lateral filing cabinet includes multiple drawers stacked one above the other (See FIG. 1). Each drawer 210, 212 and 214 is typically attached to the cabinet by a pair of telescopic rails 216, 218 and 220, one located at each end of the drawer. The telescopic rail includes a cabinet member 222 that is attached to the cabinet 200, a drawer member 226 that is attached to the drawer 212, and an intermediate member 224 that is positioned between the cabinet and drawer members (See FIG. 2). The drawer member 226 is telescopically received within the intermediate member 224 which is, in turn, telescopically received within the cabinet member 222. A bearing assembly (not shown), such as a ball cage, or other friction reducing components are sandwiched between the rails to provide smooth and easy movement of the drawer. In some applications, the intermediate member is eliminated and the drawer member is received within the cabinet member.

In applications that include multiple drawers or shelves, such as a lateral filing cabinet, it is often important to prevent more than one drawer from being drawn out of the cabinet at a time. If more than a single drawer is drawn out, there is an increased likelihood that the weight of the items contained in the drawer will upset the balance of the cabinet and cause it to tip forward. This is a well-known problem that is typically addressed by providing the cabinet with an "interlock." Interlocks are available in a variety of different constructions. One such construction is a "stacked bar" construction, which includes a number of stacked locking bars located adjacent to the telescopic rails (See FIGS. 1 and 2). The locking bars 202, 204 and 206 are arranged so that the bottom of each locking bar is generally aligned with a corresponding rail 216, 218 and 220, respectively, and are free to move vertically. An inclined surface 208 is formed at the bottom of each locking bar 202, 204 and 206 facing the corresponding rail 216,218 and 220, respectively. To actuate the locking bars 202, 204 and 206, a ramp 230 is formed on the intermediate member 224 of each rail 216, 218 and 220. The ramp 230 is in horizontal alignment with the inclined surface 208 at the bottom of the corresponding locking bar 202,204 and 206. When a drawer 212 is opened, the ramp 230 moves horizontally and, through interaction of the ramp 230 and inclined surface 208, lifts the locking bars 202 and 204 located above that slide (See FIG. 2). As a result, the inclined surfaces 208 of the locking bar 202 located above the open drawer are no longer aligned with the corresponding ramps 230. This prevents any drawers located above the open drawer from being opened. Also, the ramp 230 of the open drawer obstructs upward movement any locking bars 206 located below the open drawer. This prevents any drawers located below the open drawer from being opened.

Another common feature in many telescopic rails is a "homing device." A homing device is a mechanism that biases the rail, and consequently the drawer or shelf, in a closed position. Like interlocks, homing devices are available in a variety of different constructions. One particularly ingenious design includes a homing device 300 that is mounted to the rear of the cabinet member (See FIGS. 3 and 4). The homing device 300 includes a base 302 and a pivot arm 304 that operatively interacts with the drawer member (not shown). The homing device 300 further includes a bias clip 306 that secures the pivot arm 304 to the base 302. The bias clip 306 and pivot arm 304 are arranged in a conventional "over-center" relationship so that the bias clip 306 biases the pivot arm 304 in both open (See FIG. 4) and closed position (See FIG. 3). When the drawer is closed, the bias clip 306 biases the pivot arm 304 in the closed position, thereby biasing the drawer in the closed position. When the drawer is opened, the pivot arm 304 pivots against the bias clip 306 until it passes its center point. After which, the bias clip 306 biases the pivot arm 304 in the open position, permitting the drawer to be fully opened. When the drawer is reclosed, the drawer member causes the pivot arm 304 to pivot back against the bias clip 306 until it passes back over its center point. After it has passed back over its center point, the bias clip 306 biases the pivot arm 304 in the closed position, thereby biasing the drawer in the fully closed position.

Although existing interlock and homing device constructions provide acceptable operation, a continuing need exists for more efficient and effective constructions. In particular, a need exists for effective interlock and homing devices that are easily and inexpensively manufactured and installed, and that require a minimum of modification to existing rail systems.

SUMMARY OF THE INVENTION

The aforementioned need is satisfied by the present invention which provides a rail assembly with an integrated interlock and homing device. The interlock includes a series of locking bars and corresponding locking slides. The homing device includes an arm that is moved between open and closed positions as the rail is opened and closed, respectively. The arm is operatively connected to the corresponding locking slide. When the rail is opened, the arm is moved into the open position, thereby simultaneously opening the homing device and moving the locking slide (and locking bars) into the locked position. When the rail is closed, the arm is moved into the closed position, thereby simultaneously closing the homing device and moving the locking slide (and locking bars) into an unlocked position.

In a preferred embodiment, the homing device includes a pivot arm that is pivotally secured to a base by a resilient biasing clip. The elements are arranged in an "over-center" relationship so that the biasing clip biases the pivot arm in either the open position or the closed position, depending on the position of the arm. An actuator pin extends from the pivot arm into a slot in the locking slide so that pivotal movement of the arm results in sliding movement of the locking slide.

In a more preferred embodiment, the bottom of each locking bar includes an inclined surface facing an oppositely inclined surface on the corresponding locking slide. When a drawer is opened, the locking slide moves into the locked position with the inclined surfaces on the locking slide and locking bar interacting to lift the above locking bars and secure the below locking bars to prevent any additional drawers from being opened.

The present invention provides an effective and efficient homing device and interlock. The integrated design eliminates the need for separate interlock and homing devices. As a result, the present invention is relatively inexpensive to manufacture and install. The present invention is also easily incorporated into conventional rail systems with minimal modifications to the design of preexisting components.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 2:
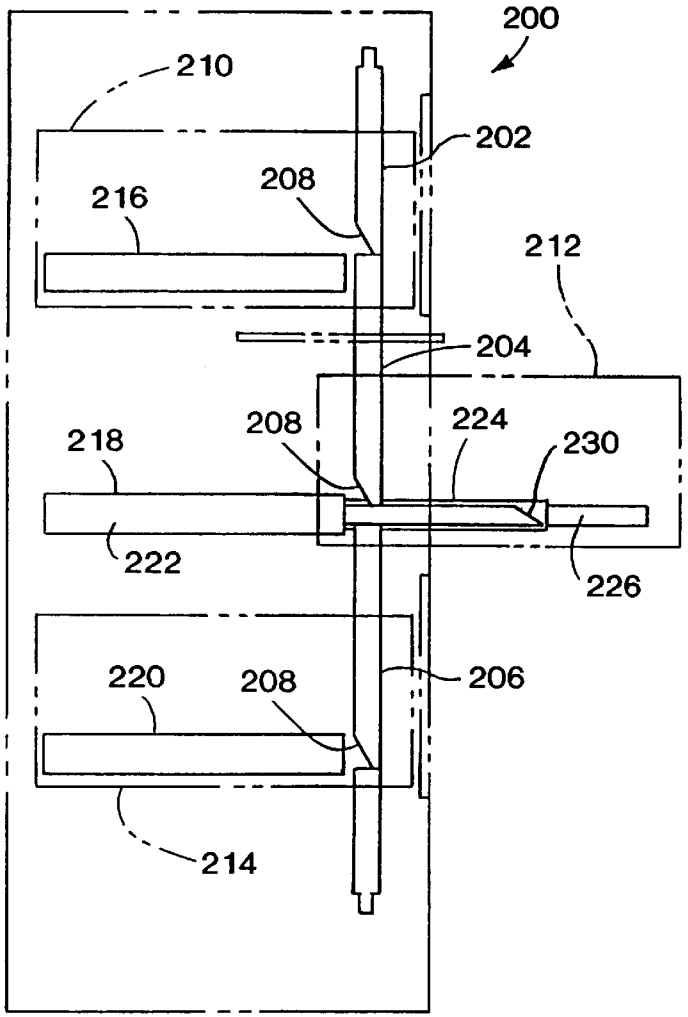
FIG. 2 PRIOR ART
FIG. 2 is a side elevational view of a prior art rail assembly with a cabinet shown in phantom lines.
Figure 1:
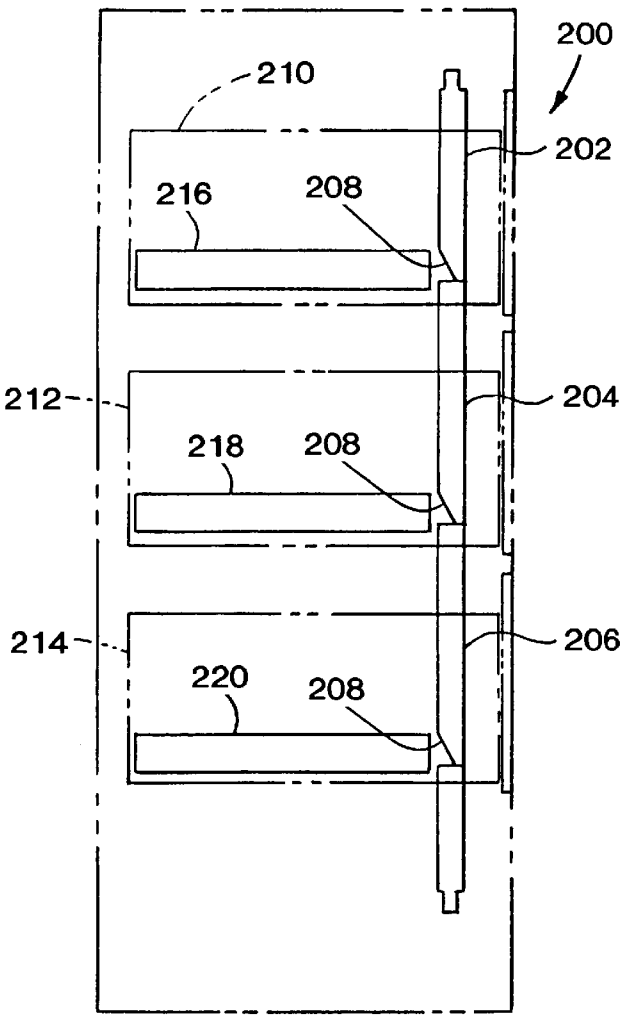
FIG. 1 PRIOR ART
FIG. 1 is a side elevational view of a prior art rail assembly with a cabinet shown in phantom lines.
Figure 3:
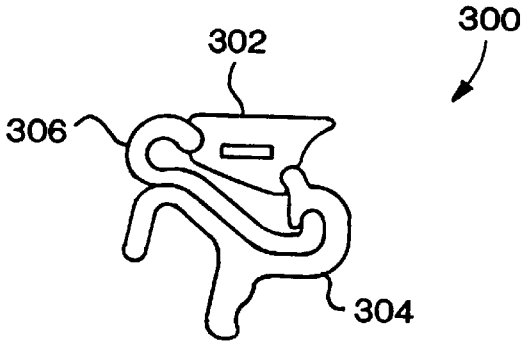
FIG. 3 PRIOR ART
FIG. 3 is a right side elevational view of a prior art homing device in the closed position.
Figure 4:
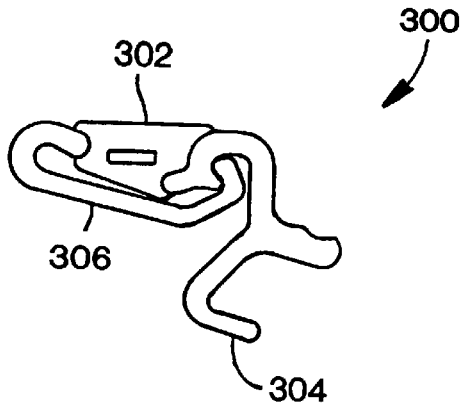
FIG. 4 PRIOR ART
FIG. 4 is a right side elevational view of a prior art homing device in the open position.
Figure 5:
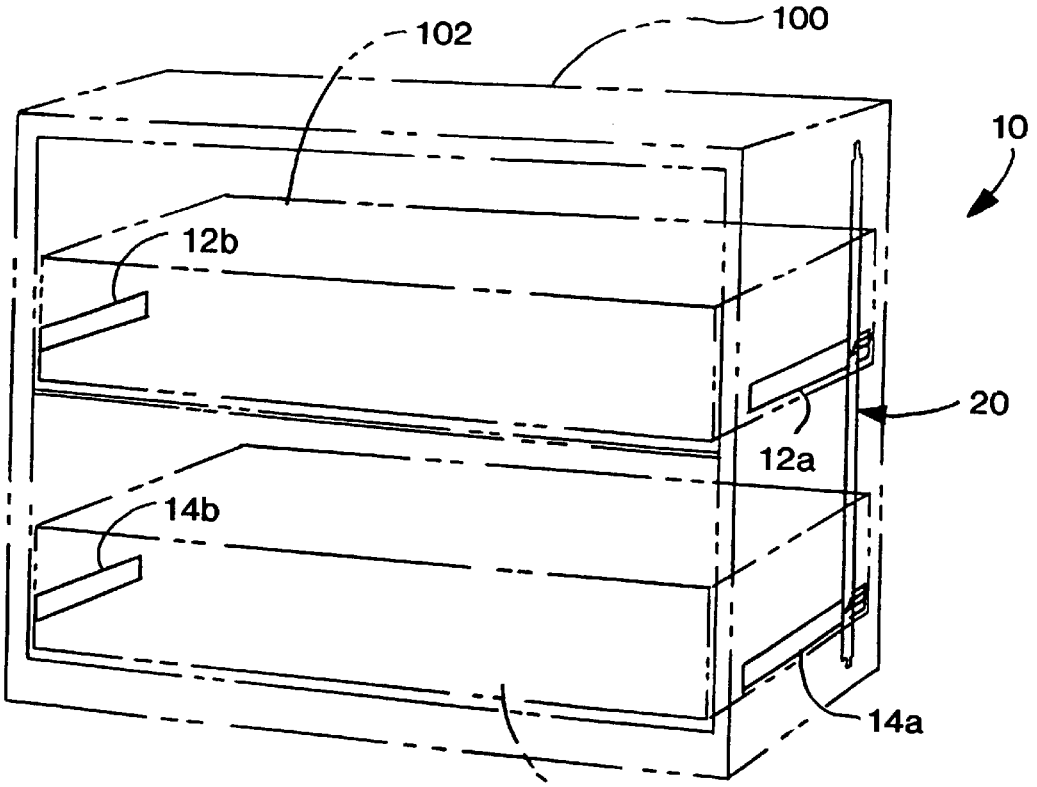
FIG. 5 is a perspective view of a rail assembly incorporating the present invention with a cabin in phantom lines.
Figure 6:
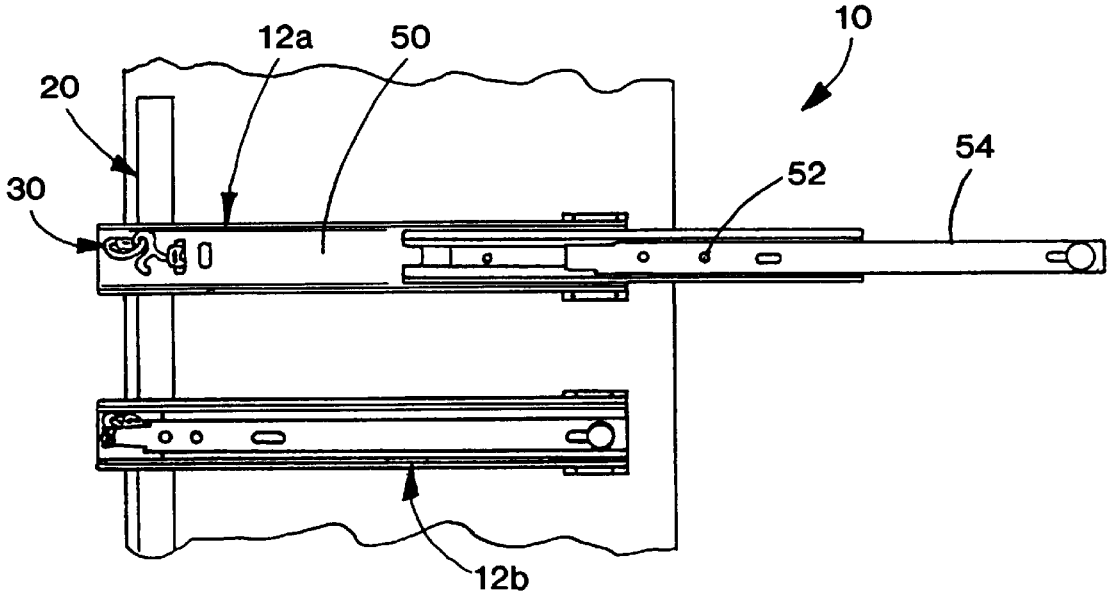
FIG. 6 is a right side elevational view of a portion of a cabinet showing upper and lower rails with the upper rail extended and the lower rail retracted.

A rail assembly according to a preferred embodiment of the present invention is illustrated in FIG. 5, and generally designated 10. This illustration shows the present invention incorporated into a conventional two-drawer lateral filing cabinet. For purposes of disclosure, the present invention will be described in connection with a lateral filing cabinet 100 having two vertically stacked lateral drawers 102, 104 (See FIGS. 6–15). The lateral filing cabinet 100 includes upper and lower rails mounted to opposite walls of the cabinet 100 to support the drawers 102, 104. As an expedient, the present invention will be described primarily with respect to the portion of the rail assembly 10 mounted to the right wall of the cabinet 100. It will be readily apparent to those skilled in the art that a complete rail assembly includes a mirror set of rails on the left side of the cabinet, as shown in FIG. 5. The mirror set of rails may or may not include a homing device and an interlock, depending on the application. It should also be noted that while the present invention is described in connection with a telescopic drawer assembly for a conventional lateral filing cabinet, it is also well suited for use in a wide variety of other drawer or rail assemblies in a wide variety of furniture. The terms "forward" and "rearward" will be used in this disclosure to denote directions toward the front or back, respectively, of the cabinet when the cabinet is in normal use.

In general, the rail assembly 10 includes two pair of rails 12*a–b* and 14*a–b* mounted to the inside of the filing cabinet 100. The rails 12*a–b* and 14*a–b* support drawers 102 and 104, and are extendable to allow the drawers 102 and 104 to be drawn-out from the cabinet 100. The rail assembly 10 further includes an interlock 20 mounted to the inside of the filing cabinet 100. As described in more detail below, the interlock 20 interacts with the rails 12*a* and 14*a* to prevent more than one drawer from being drawn-out of the cabinet 100 at a single time. Although the rail assembly 10 is described with a single interlock 20 located on the right side of the cabinet 100, the interlock 20 can alternatively be located on the left side of the cabinet 100 or two interlocks can be installed, one on each side of the cabinet. Each rail 12*a–b* and l4*a–b* includes a homing device 30 that biases the rail, and consequently the corresponding drawer, in the closed position (See FIG. 6). As described in more detail below, the homing device 30 includes a pivot arm 36 that operates the interlock 20 as a drawer is opened and closed.

Figure 7:
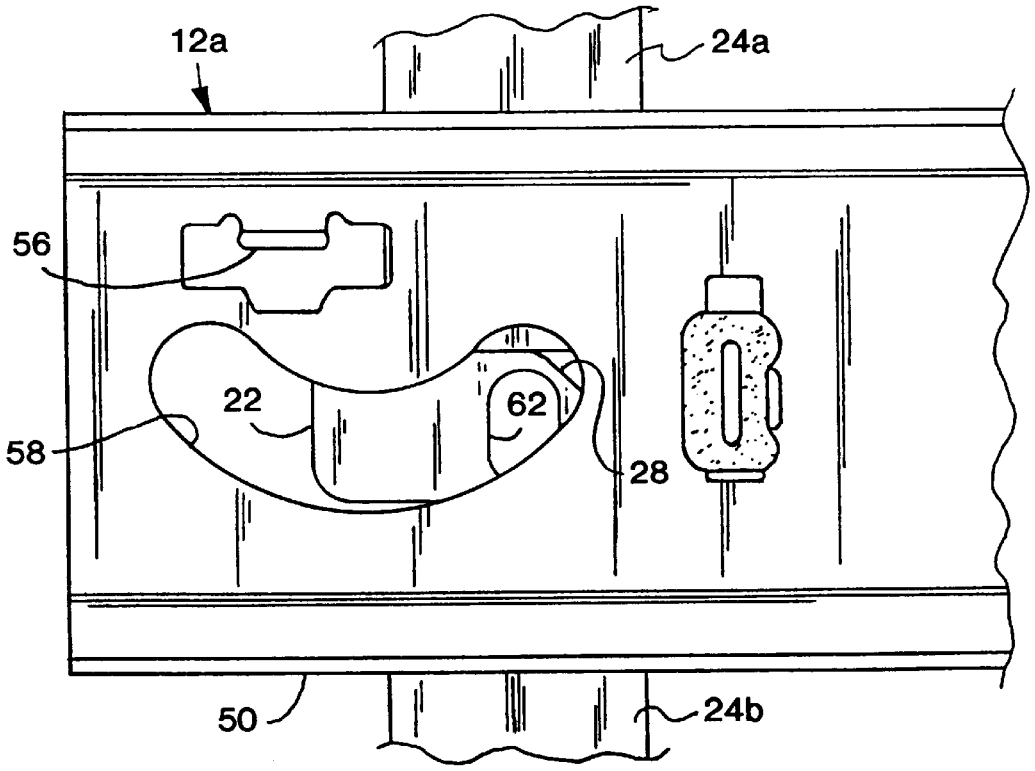
FIG. 7 is an enlarged right side elevational view of a portion of the cabinet member.
Figure 8:
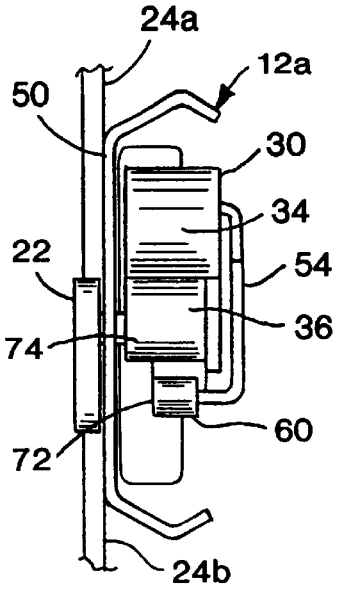
FIG. 8 is an enlarged rear elevational view of a portion of the upper rail assembly.

As noted above, the drawer assembly 10 includes two pair of rails 12*a–b* and 14*a–b* mounted to the interior of the cabinet 100. The rails 12*a–b* and 14*a–b* can be mounted directly to the wall of the cabinet 100 or to a support wall (not shown) or support beams (not shown) disposed inwardly from the wall of the cabinet 100. The rails 12*a–b* and 14*a–b* are generally conventional, and therefore will not be described in detail. Suffice it to say that each pair includes a right rail 12*a* and 14*a* interconnected between the right end of the corresponding drawer and the right sidewall of the cabinet 100, and a left rail 12*b* and 14*b* interconnected between the left end of the corresponding drawer and the left sidewall of the cabinet 100. Each rail includes a cabinet member 50, an intermediate member 52 telescopically received within the cabinet member 50 and a drawer member 54 telescopically received within the intermediate member 52 (See FIG. 6). Conventional bearings, bushings or other similar elements are located between the rails to provide smooth and easy extension and retraction of the rail. The cabinet member 50 is fixedly attached to the wall of the cabinet 100. Referring now to FIG. 7, the cabinet member 50 includes a mounting tab 56 and a defines an opening 58 disposed adjacent to and below the mounting tab 56. The opening 58 is preferably arcuate to correspond with pivotal movement of pivot arm 36. The drawer member 54 is fixedly attached to the end of the drawer and includes a finger 60 that operatively connects the drawer member 54 with the homing device 30 (See FIGS. 8 and 9). The finger 60 is preferably formed integrally with the drawer member 54. The drawer member 54 may also include a plastic sleeve 72 mounted over finger 60. The plastic sleeve 72 is preferably frictionally fitted onto the finger 60.

A homing device 30 is typically mounted to each rail 12*a* and 14*a*. As perhaps best shown in FIGS. 10, 11 and 12, the homing device 30 generally includes a mounting base 32, a bias clip 34 and pivot arm 36. The various element of the homing device 30 are preferably manufactured from nylon or other similar materials using conventional injection molding techniques and apparatus. In some applications, it may be necessary to reinforce the nylon with fiberglass or other similar fillers depending on the desired strength and durability characteristics. The mounting base 32 defines a central opening 35 that is adapted to be frictionally fitted over mounting tab 56 to secure the homing device 30 to the rail 12*a* and 14*a*. The mounting base 32 further defines a pivot arm socket 38 and a bias clip socket 40 (See FIG. 10). The pivot arm 36 is pivotally secured to the base 32. The pivot arm 36 is relatively complex in shape, and includes a first end that terminates at ball 46 and a second end that terminates at catch 42 (See FIGS. 14–17). The ball 46 is pivotally fitted within pivot arm socket 38 to permit the pivot arm 36 to pivot between an open position (See FIG. 12) and a closed position (See FIG. 11). The pivot arm 36 defines a bias clip socket 48 disposed near ball 46. The catch 42 is generally c-shaped and is adapted to receive finger 60. The catch 42 includes spaced fingers 74 and 76. The pivot arm 36 further includes a web 64 bridging a portion of the catch 42 and an actuator pin 44 protruding from the web 64 perpendicularly to the longitudinal extend of the pivot arm 36. The actuator pin 44 extends through opening 58 in the cabinet member 50 to operatively engage the corresponding locking slide 22, as described below. The bias clip 34 extends between the pivot arm 36 and the base 32, and is manufactured from a resilient material, such as nylon. The bias clip 34 is somewhat c-shaped, and its opposite ends terminate at balls 66 and 68. The ball 66 is pivotally fitted within bias clip socket 40 to permit the bias clip 34 to pivot with respect to the base 32. The ball 68 is pivotally fitted within bias clip socket 48 to permit the bias clip 34 to pivot with respect to the pivot arm 36. The various elements of the homing device 30 are arranged in an "over-center" relationship so that the bias clip 34 biases the pivot arm 36 in either the open position or the closed position, depending on the position of the arm 36 as described below.

The interlock 20 includes a plurality of locking slides 22 (one for each drawer 102 and 104) and a plurality of vertically stacked locking bars 24*a–c*. The locking bars 24*a–c* are mounted inside of the cabinet 100 in a stacked configuration, one atop another, and are preferably secured to the rails 12*a* and 12*b* by mounting cover 80, described below. Alternatively, the locking bars 24*a–c* may be mounted within a vertical channel (not shown) in the wall of the cabinet 100 or may be secured in place by slotted mounting tabs (not shown) attached to the wall of the cabinet 100. In any event, the locking bars 24*a–c* are permitted to travel vertically in response to movement of the locking slides 22. The locking bars 26*a–c* are configured so that the tops of locking bars 24*b–c* are horizontally aligned with the bottom of the corresponding locking slides 22. Locking bars 24*a–b* each include an inclined edge 26, which as described below, permits the locking bars 24*a–b* to be lifted through operation of the locking slides 22. The locking bars 24*a–c* are preferably manufactured from steel using conventional stamping techniques and apparatus.

Figure 23:
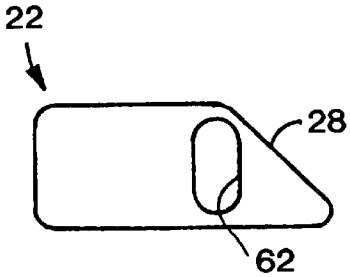
FIG. 23 is a front elevational view the locking slide.
Figure 24:
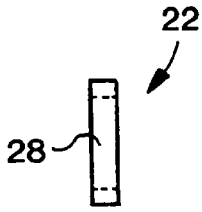
FIG. 24 is a side elevational view the locking slide.

A locking slide 22 is slidably mounted by each rail 12*a* and 14*a*, adjacent to the corresponding opening 58 and locking bar 24*a–b*. The locking slides 22 are preferably secured to the rails 12*a* and 14*a* by mounting cover 80, described below. Alternatively, the locking slides 22 may be mounted within a horizontal channel (not shown) in the wall of the cabinet 100 or may be secured in place by slotted mounting tabs (not shown) attached to the wall of the cabinet 100. The locking slides 22 are preferably manufactured from nylon or other similar materials using conventional injection molding techniques and apparatus. Referring now to FIGS. 23 and 24, each locking slide 22 includes an inclined edge 28 that, when installed, faces the inclined edge 26 of the corresponding locking bar 24. Each locking slide 22 also defines a slot 62 that receives the actuator pin 44 of the pivot arm 36. The slot 62 is elongated in the vertical direction to permit lost vertical movement of the pin 44 as the pivot arm 36 swings. The dimensions of the slot 62 will vary from application to application, but are preferably sufficient to permit the pivot arm 36 to travel through the desired range of motion (e.g. between the open and closed positions).

Figure 25:
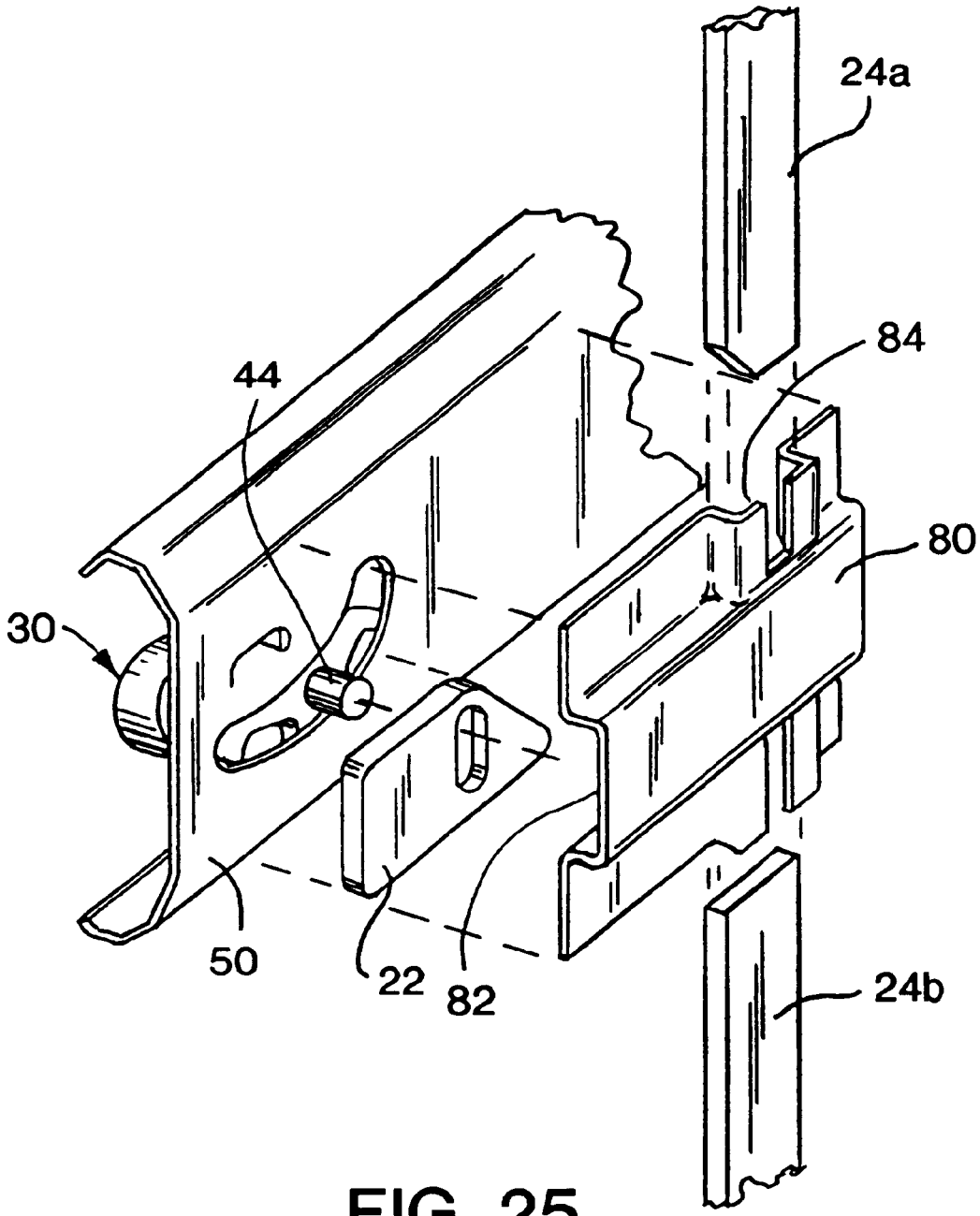
FIG. 25 is an exploded perspective view of a portion of the rail assembly.

Referring now to FIG. 25, the locking slide 22 and locking bars 24*a–d* are secured to the rails by mounting cover 80. The cover 80 defines a horizontal channel 82 that slidably receives the locking slide 22 and a vertical channel 84 that slidably receives the opposed ends of adjacent locking bars 24*a–d*. The locking slide 22 and locking bars 24*a–d* are slidably retained on the same plane so that the locking slide 22 and locking bars 24*a–b* mechanically interact. The horizontal channel 82 is of sufficient length to shepherd the locking slide 22 throughout the locking slides 22 entire range of motion. Similarly, the vertical channel 84 is of sufficient length to shepherd the locking bars 24*a* and 24*b* throughout their entire range of motion. The cover 80 is attached to the cabinet member 50 preferably by welding or by conventional fasteners. The cover 80 is preferably manufactured from steel using conventional stamping operations.

Operation

Figure 18:
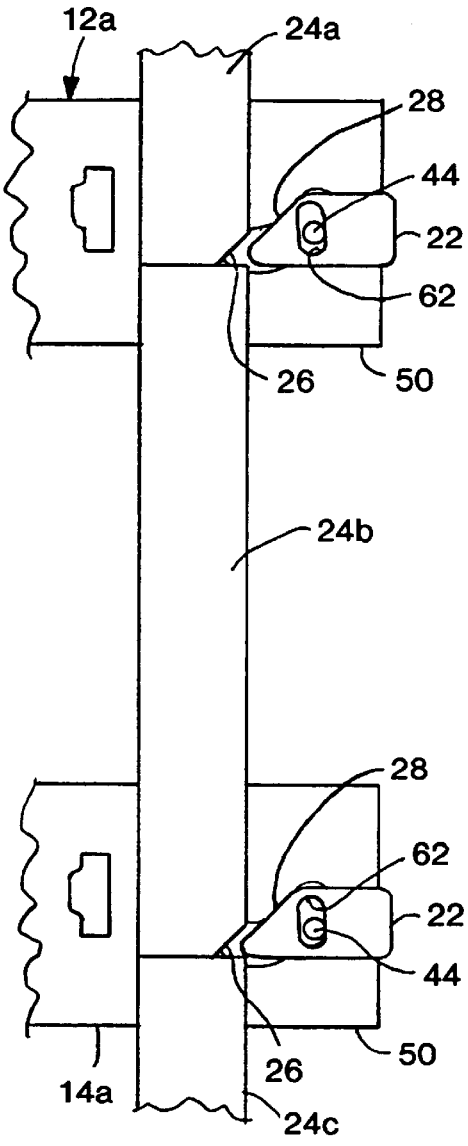
FIG. 18 is a right side elevational view of a portion of the rail assembly showing both rails in the closed position.
Figure 19:
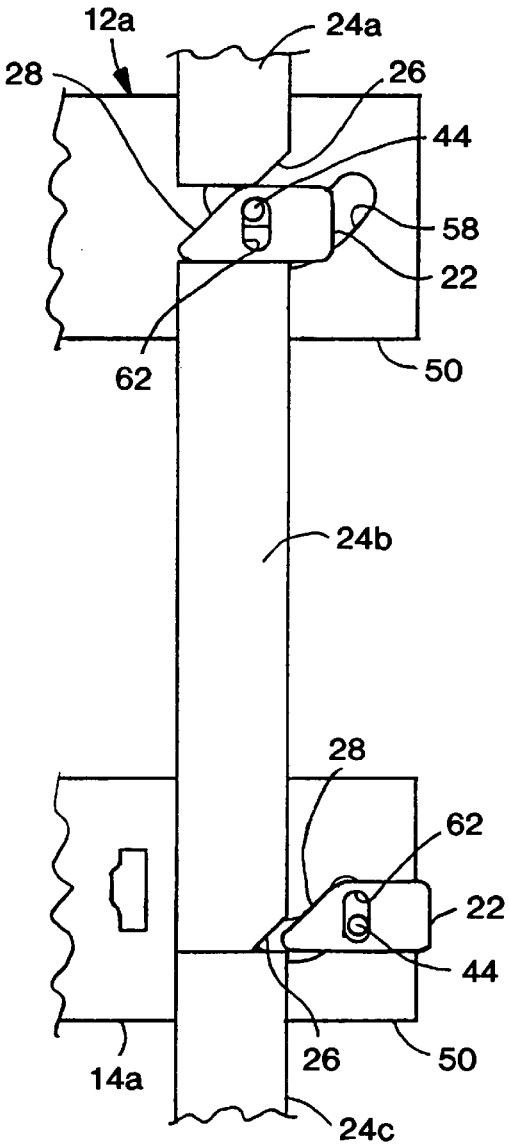
FIG. 19 is a right side elevational view of a portion of the rail assembly showing the upper rail in the open position.
Figure 20:
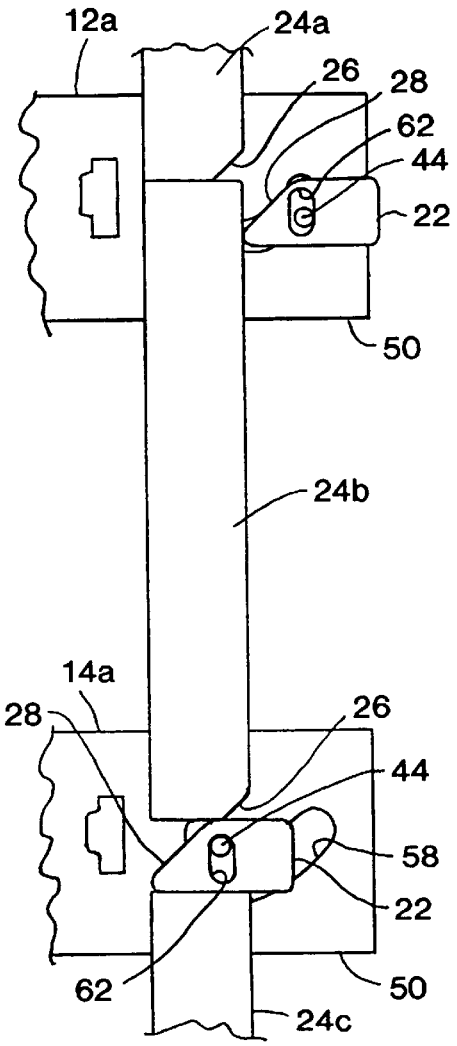
FIG. 20 is a right side elevational view of a portion of the rail assembly the lower rail in the open position.
Figure 21:
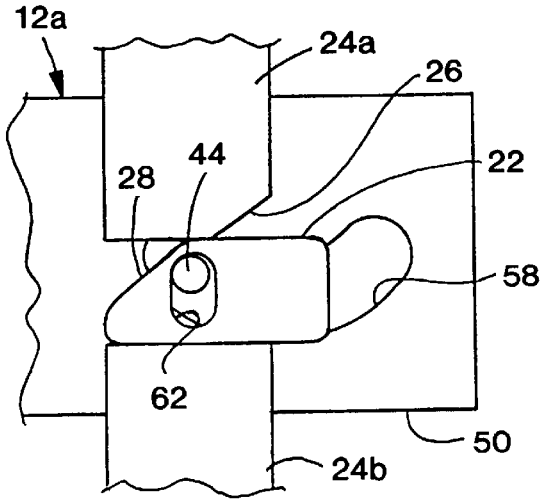
FIG. 21 is an enlarged right side elevational view of a portion of the rail assembly showing a locking slide in the unlocked position.
Figure 22:
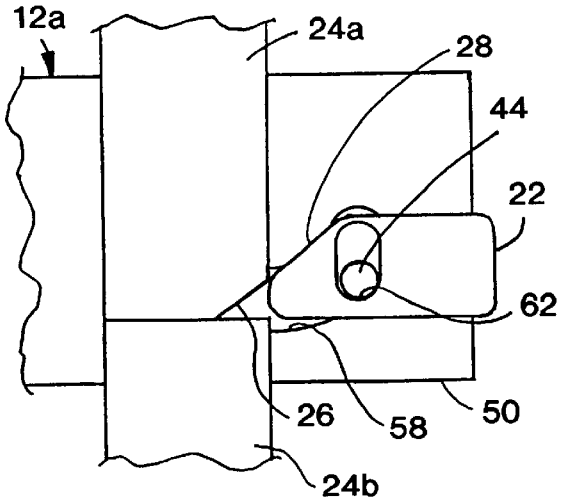
FIG. 22 is an enlarged right side elevational view of a portion of the rail assembly showing a locking slide in the locked position.

Operation of the present invention will be described primarily in connection with FIGS. 18–22. FIG. 18 shows the rail assembly 10 with both rails 12*a* and 14*a* closed. In operation, the pivot arm 36 operatively interacts with the rail 12*a* by mechanical interaction between finger 60 and catch 42. When the rail 12*a* is fully closed, the pivot arm 36 is located in the closed position (See FIG. 11). By virtue of the "over-center" configuration of the homing device 30, the bias clip 34 initially biases the pivot arm 36 in this position. When the rail 12*a* is pulled forwardly, the finger 60 engages catch 42 and attempts to swing the pivot arm 36 out of the closed position. The bias clip 34 initially resists this motion and attempts to urge the drawer back into a fully closed position. Once the rail 12*a* is pulled forwardly a sufficient distance (against the bias clip 34), the pivot arm 36 passes its center point and the bias clip 34 urges the pivot arm 36 into the open position (See FIGS. 9 and 12). In the open position, the catch 42 opens forwardly, thereby releasing the finger 60 and permitting the rail 12*a* to be fully opened. As the pivot arm 36 moves from the closed position to the open position, it moves the corresponding locking slide from the unlocked position (See FIG. 21) to locked position (See FIG. 22). Specifically, as pivot arm 36 moves, actuator pin 44 travels an arcuate path through opening 58. Because the pin 44 is received within slot 62, the horizontal component of the actuator pin's movement is translated into horizontal movement of the locking slide 22. The vertical component of the actuator pin's movement is lost as the pin 44 travels vertically through slot 62. As perhaps best shown in FIGS. 19 and 20, movement of the locking slide 22 into the locked position results in actuation of the locking bars 24*a–c*. When the upper rail 12*a* is opened, the upper locking slide 22 lifts locking bar 24*a* and prevents locking bar 24*b* from being lifted. This prevents the lower locking slide 22 from being moved into the locked position, thereby preventing the lower rail 14*a* from being opened (See FIG. 19). When the lower rail 14*a* is opened, the lower locking slide 22 lifts locking bars 24*a–b* so that the upper locking slide 22 is no longer aligned with the inclined surface 26 on locking bar 24*a*. This prevents the upper locking slide 22 from being moved into the locked position, thereby preventing the upper rail 12*a* from being opened.

Figure 9:
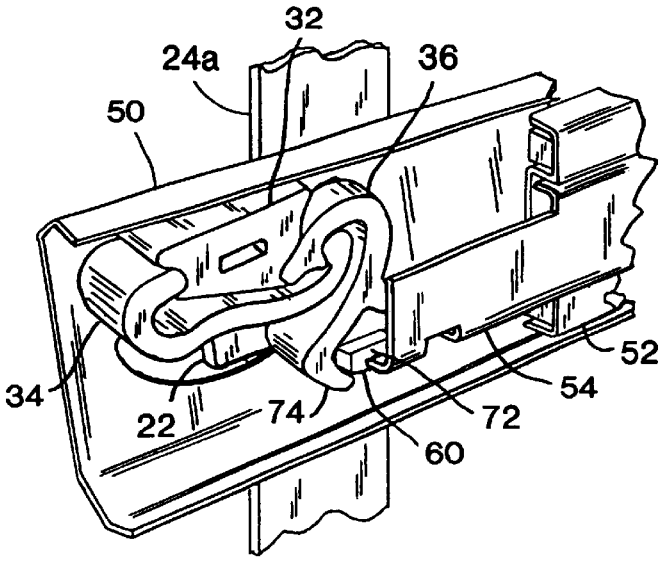
FIG. 9 is an enlarged perspective view of a portion of the rail assembly with rail partially extended.
Figure 11:
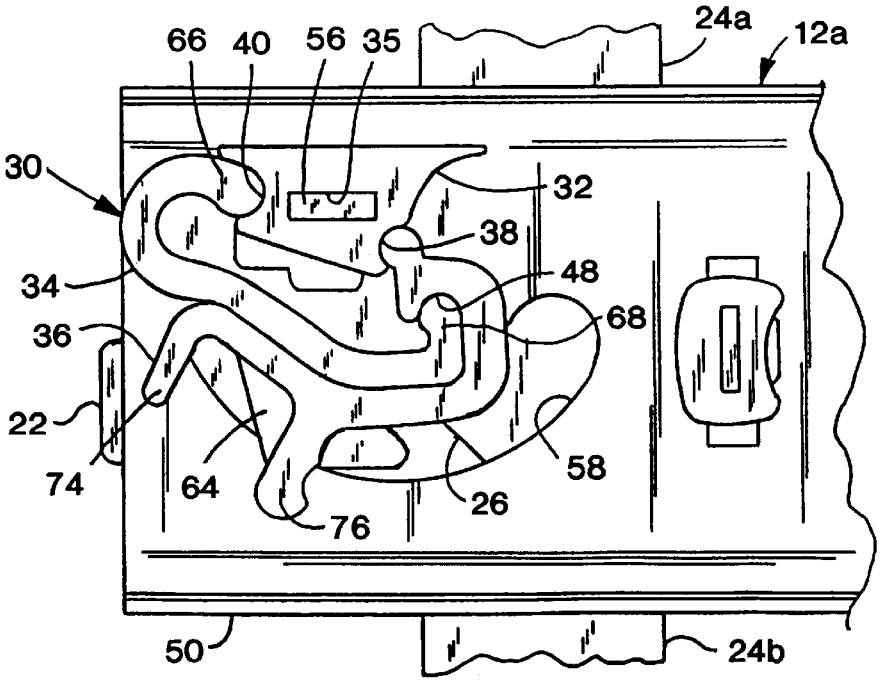
FIG. 11 is an enlarged left side elevational view of a portion of the upper rail with the intermediate and drawer members removed showing the homing device in the closed position.
Figure 10:
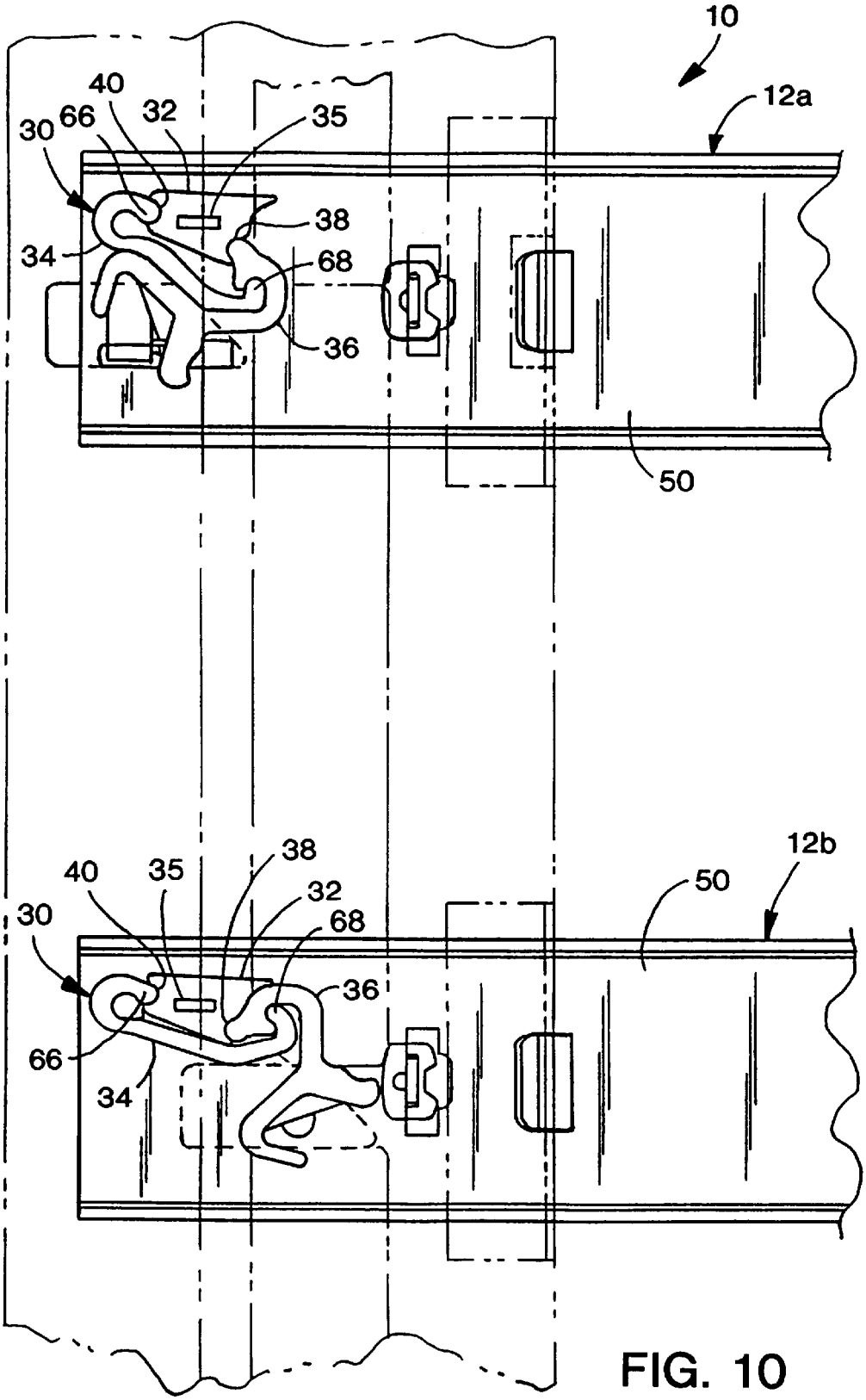
FIG. 10 is a right side elevational view of a portion of the rail assembly with the intermediate and drawer members removed showing the upper rail in the closed position and the lower rail in the open position.
Figure 12:
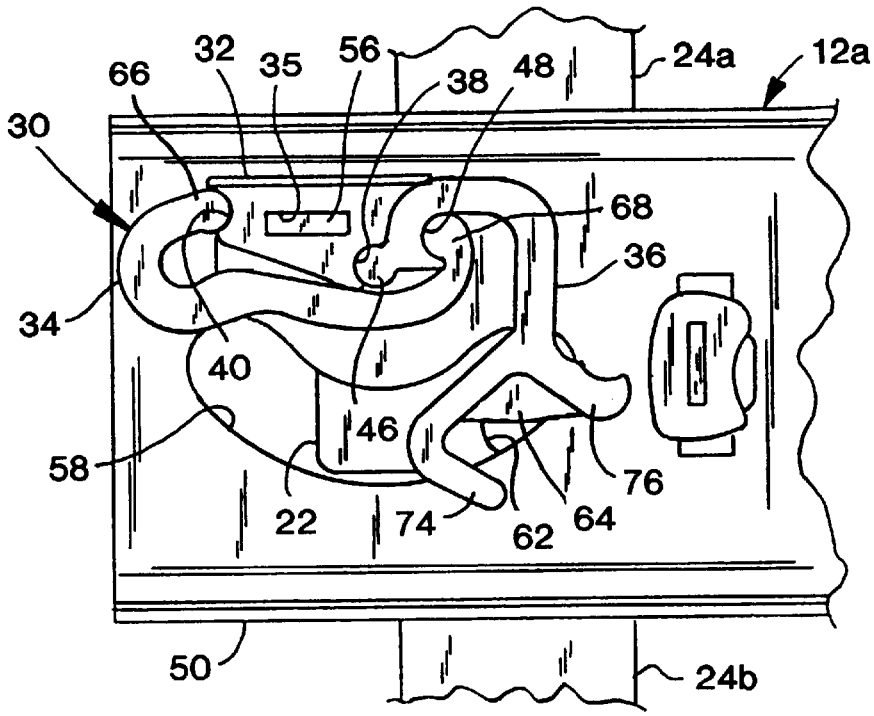
FIG. 12 is an enlarged left side elevational view of a portion of the upper rail with the intermediate and drawer members removed showing the homing device in the open position.
Figure 13:
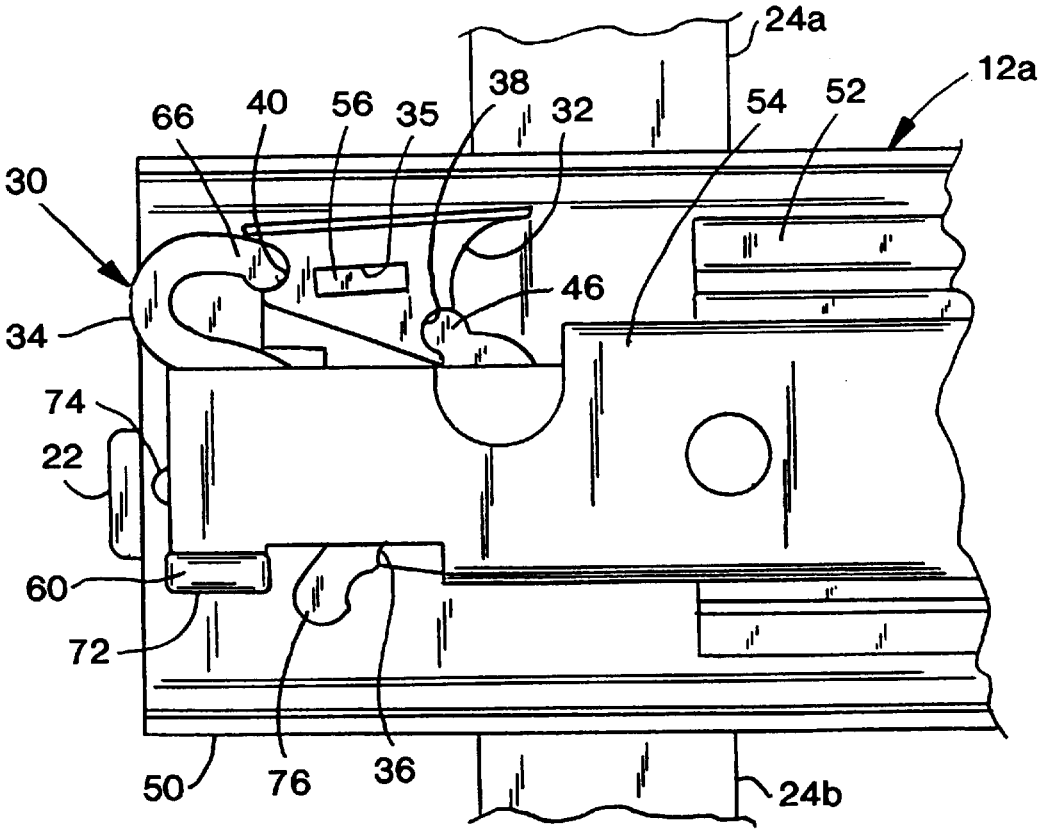
FIG. 13 is an enlarged left side elevational view of a portion of the upper rail showing the homing device in the closed position.
Figure 14:
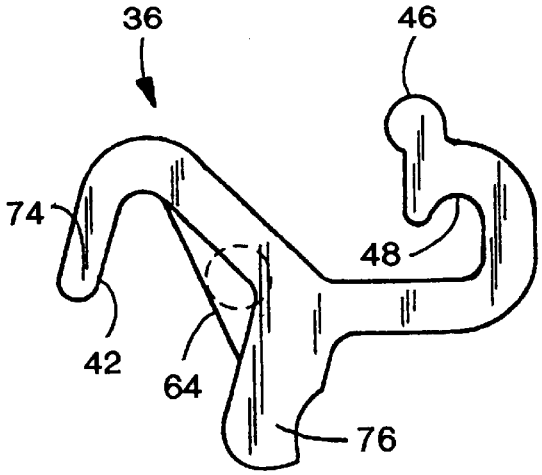
FIG. 14 is front elevational view of the pivot arm.
Figure 15:
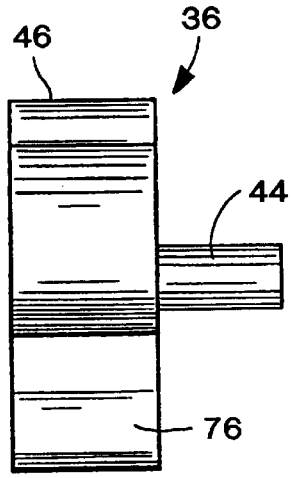
FIG. 15 is a right side elevational view of the pivot arm.
Figure 16:
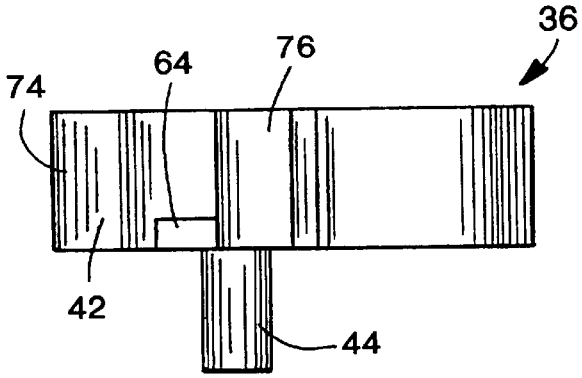
FIG. 16 is a top plan view of the pivot arm.
Figure 17:
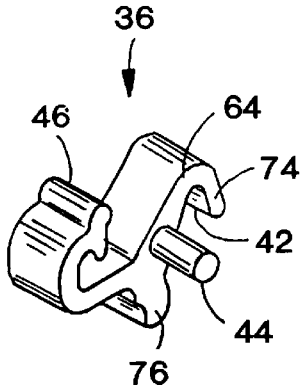
FIG. 17 is a perspective view of the pivot arm.

As the drawer 102 is closed, the finger 60 eventually re-engages the catch 42 (See FIG. 9). Further rearward motion of the drawer 102, causes the pivot arm 36 to swing rearwardly against the bias of the biasing clip 34. Once the drawer 102 is pushed rearwardly a sufficient distance, the pivot arm 36 passes its center point and the bias clip 34 urges the pivot arm 36 back into the closed position. As the pivot arm 36 moves from the open position to the closed position, it moves the corresponding locking slide 22 from the locked position (See FIG. 22) to the unlocked position (See FIG. 21). Specifically, as pivot arm 36 moves, actuator pin 44 travels an arcuate path back along arcuate opening 58. Because the pin 44 is received within slot 62, the horizontal component of the actuator pin's movement is translated into horizontal movement of the locking slide 22. The vertical component of the actuator pin's movement is simply lost as the pin 44 travels vertically through slot 62. When the locking slide 22 is returned to the unlocked position, the locking bars 24*a–c* return to the unlocked position (See FIG. 18), thereby allowing any drawer to be opened.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A rail assembly for stacked drawers, comprising:

at least two telescopic rails each having a cabinet member and a telescoping member capable of telescopic movement with respect to said cabinet member;

a plurality of vertically stacked locking bars, said locking bars capable of limited vertical movement along a path;

at least two locking slides moveably mounted adjacent to said locking bars and said telescopic rails, each of said locking slides capable of movement between an unlocked position outside of said path of said locking bars and a locked position within said path of said locking bars, wherein movement of one of said locking slides into said locked position prevents movement of any additional locking slides into said locked position; and a homing device mounted to each of said cabinet members, each of said homing devices including a pivot arm capable of movement between open and closed positions, each of said homing devices including a biasing means for biasing said pivot arm in said closed position, each of said homing devices further including an actuator pin operatively engaged with a corresponding one of said locking slides such that movement of said homing device into said open position causes movement of said corresponding locking slide into said locked position, thereby preventing movement of any further locking slides into said locked position.

2. The assembly of claim 1 wherein said pivot arm is pivotally mounted to said cabinet member, said pivot arm including a catch, said telescoping member including a finger adapted to operatively engage said catch such that said finger pivots said pivot arm between said open position and said closed position as said telescoping member undergoes telescopic movement.

3. The assembly of claim 2 wherein each of said locking bars includes a lower end, each of said locking slides being mounted adjacent to said lower end of a corresponding one of said locking bars, at least one of said locking slide and said corresponding locking bar including an inclined surface such that movement of said locking slide into said locked position causes vertical displacement of said corresponding locking bar.

4. The assembly of claim 3 wherein each said locking slide and said lower end of each corresponding locking bar include oppositely inclined surfaces to facilitate vertical displacement of said corresponding locking bar.

5. The assembly of claim 4 wherein said homing device further includes a base and a bias clip, said base being mounted directly to said corresponding cabinet member and defining a socket pivotally receiving said pivot arm, said bias clip extending between and interconnecting said pivot arm and said base.

6. The assembly of claim 5 wherein said base, said bias clip and said pivot arm are configured in an over-center relationship such that said pivot arm is biased in one of said open position and said closed position depending on a position of said pivot arm.

7. The assembly of claim 6 wherein each of said locking slides defines an aperture receiving said actuator pin of said corresponding pivot arm.

8. The assembly of claim 7 wherein said aperture is further defined as a vertically extended slot, whereby a vertical component of movement of said actuator pin is lost.

9. The assembly of claim 8 further comprising a mounting plate mounted to one of said rails, said mounting plate supporting said corresponding locking slide and said corresponding locking bar, said mounting plate defining a vertical channel for slidably receiving said corresponding locking bar and a horizontal channel for slidably receiving said corresponding locking slide.

10. A cabinet comprising:

a cabinet housing a plurality of vertically stacked drawers;

a rail assembly for supporting said drawers within said cabinet, said rail assembly including a plurality of rails, each of said rails interposed between a corresponding one of said drawers and said cabinet, each of said rails being movable between an extended position in which said corresponding drawer is open and a closed position in which said corresponding drawer is closed;

a plurality of homing devices each uniquely associated with one of said rails, each of said homing devices being movable by operation of a corresponding one of said rails between a closed position when said corresponding rail is in said retracted position and an open position when said corresponding rail is in said extended position, each of said homing devices including biasing means for biasing said corresponding rail in said retracted position; and an interlock including a plurality of stacked locking bars disposed adjacent to said rails, said interlock further including a plurality of locking slides, one of said locking slides being uniquely associated with each of said drawers, each of said locking slides being movable by a corresponding one of said homing devices between an unlocked position when said corresponding homing device is in said closed position and a locked position when said corresponding homing device is in said open position, said locking bars and said locking slides configured such that only a single locking slide can be in said locked position at a given time, whereby only a single drawer can be opened at a given time.

11. The cabinet of claim 10 wherein each of said rails includes a cabinet member fixed with respect to said cabinet and a telescoping member movable with respect to said cabinet member; and each of said homing devices includes a pivot arm pivotally mounted with respect to a corresponding one of said cabinet members, said pivot arm being movable between said open position and said closed position by movement of a corresponding one of said telescoping members with respect to said cabinet member.

12. The cabinet of claim 11 wherein each of said homing devices further includes a base and a bias clip, said base being mounted directly to said corresponding cabinet member and defining a socket pivotally receiving said pivot arm, said bias clip extending between and interconnecting said pivot arm and said base.

13. The cabinet of claim 12 wherein each of said pivot arms includes a catch, said telescoping member including a finger adapted to operatively engage said catch of said corresponding pivot arm such that said finger pivots said pivot arm between said open position and said closed position as said telescoping member undergoes telescopic movement.

14. The cabinet of claim 13 wherein said locking bars are vertically stacked and capable of vertical movement with respect to said rails.

15. The cabinet of claim 14 wherein each of said locking bars includes a bottom edge and each of said locking slides includes a bottom edge, said bottom edge of each of said locking slides being aligned with said bottom edge of a corresponding locking bar.

16. The cabinet of claim 15 wherein at least one of said locking slide and said corresponding locking bar includes an inclined surface such that movement of said locking slide into said locked position causes vertical displacement of said corresponding locking bar.

17. The cabinet of claim 16 wherein each of said locking slides and each of said corresponding locking bars include oppositely inclined surfaces to facilitate vertical displacement of said corresponding locking bar by said locking slide.

18. The cabinet of claim 17 wherein each of said locking slides defines an aperture receiving said actuator pin of said corresponding pivot arm.

19. The cabinet of claim 18 wherein said aperture is further defined as a vertically extended slot, whereby a vertical component of movement of said actuator pin is lost.

20. The cabinet of claim 19 further comprising a mounting plate mounted to one of said rails, said mounting plate supporting a corresponding locking slide and a corresponding locking bar, said mounting plate defining a vertical channel for slidably receiving said corresponding locking bar and a horizontal channel for slidably receiving said corresponding locking slide.

21. An integrated interlock and homing device for a plurality of stacked drawers comprising:

a plurality of rails adapted to support the drawers, each of said rails selectively movable between a retracted position and an extended position;

a plurality of homing devices each corresponding with one of said rails, each of said homing devices including biasing means for biasing said corresponding rail in said retracted position, each of said homing devices being selectively movable from a closed position to an open position by movement of said corresponding rail from said retracted position to said extended position and from said open position to said closed position by movement of said corresponding rail from said extended position to said retracted position;

a plurality of locking slides each operatively coupled to a corresponding one of said homing devices, said locking slides movable from an unlocked position to a locked position by movement of said corresponding homing device from said closed position to said open position and from said locked position to said unlocked position by movement of said corresponding homing device from said open position to said closed position; and a plurality of locking bars disposed adjacent to said rails, said locking bars being movable between unlocked and locked positions by operation of said locking slides, said locking bars being in said unlocked position when all of said locking slides are in said unlocked position, said locking bars being in said locked position when any one of said locking slides is in said locked position, said locking bars permitting movement of any one of said locking slides into said locked position when said locking bars are in said unlocked position, said locking bars preventing movement of any further of said locking slides into said locked position when said locking bars are in said locked position, whereby said interlock permits opening of any single drawer while prohibiting more than a single drawer from being open at the same time.

22. The device of claim 21 wherein each of said rails includes a fixed member and a movable member movably mounted with respect to said fixed member; and each of said homing devices includes a pivot arm pivotally mounted to said fixed member of said corresponding rail, said pivot arm being pivotal by movement of said movable member of said corresponding rail with respect to said fixed member of said corresponding rail to selectively move said homing device between said open position and said closed position.

23. The device of claim 22 wherein each of said pivot arms includes a actuator operatively coupled to said corresponding locking slide, said actuator protruding from said pivot arm and being adapted to move said locking slide between said locked position and said unlocked position by pivotal movement of said pivot arm.

24. The device of claim 23 wherein each of said pivot arms includes a catch, said movable member of said corresponding rail including a finger adapted to operatively engage said catch such that said finger moves said homing device between said open position and said closed position by pivoting said pivot arm as said movable member undergoes movement.

25. The device of claim 24 wherein each of said homing devices further includes a base and a bias clip, said base being mounted directly to said fixed member of said corresponding rail and defining an arm socket pivotally receiving said pivot arm, said bias clip extending between and interconnecting said pivot arm and said base.

26. The device of claim 25 wherein each of said pivot arms includes a ball pivotally fitted within said arm socket of said corresponding base.

27. The device of claim 26 wherein each of said clips is generally c-shaped and includes a base ball and a pivot arm ball disposed at opposite ends of said clip, said base defining a clip socket pivotally receiving said base ball of said clip, said pivot arm defining a clip socket pivotally receiving said pivot arm ball of said clip.

28. The device of claim 27 wherein said locking bars are vertically stacked and capable of vertical movement with respect to said rails.

29. The device of claim 28 wherein each of said locking bars includes a bottom edge and each of said locking slides includes a bottom edge, said bottom edge of each of said locking slides being aligned with said bottom edge of a corresponding locking bar.

30. The device of claim 29 wherein at least one of said locking slide and said corresponding locking bar includes an inclined surface such that movement of said locking slide into said locked position causes vertical displacement of said corresponding locking bar.

31. The device of claim 30 wherein each of said locking slides and each of said corresponding locking bars include oppositely inclined surfaces to facilitate vertical displacement of said corresponding locking bar by said locking slide.

32. The device of claim 31 wherein each of said locking slides defines an aperture receiving said actuator of a corresponding one of said pivot arms.

33. The device of claim 32 wherein said aperture is further defined as a vertically extended slot, whereby a vertical component of movement of said actuator is lost.

34. The device of claim 21 further comprising a mounting plate mounted to one of said rails, said mounting plate supporting a corresponding locking slide and a corresponding locking bar, said mounting plate defining a vertical channel for slidably receiving said corresponding locking bar and a horizontal channel for slidably receiving said corresponding locking slide selectively movable between an open position and a closed position in response to movement of said telescopic rail with respect to said cabinet rail, said homing device.

35. An assembly comprising:

a cabinet having a plurality of drawers and an interlock that permits only a single of said drawers to be open at a given time; and a rail assembly including;

a cabinet rail fixedly mounted with respect to said cabinet;

a telescopic rail movably mounted to said cabinet rail; and a homing device mounted to said cabinet rail, said homing device selectively movable between an open position and a closed position in response to movement of said telescopic rail respect to said cabinet rail, said homing device biasing said cabinet rail in said closed position when said cabinet rail is in said closed position, said homing device including a means for operating said interlock in response to movement of said homing device between said open position and said closed position.

36. The assembly of claim 35 wherein said means for operating said interlock includes an actuator pin from said homing device.

37. The assembly of claim 36 wherein said interlock includes a locking slide movable between an unlocked position and a locked position, said actuator pin operatively engaged with said locking slide, whereby movement of said locking slide between said open position and said closed position results in movement of said locking slide between the unlocked position and the locked position.

* * * * *

UNITED STATES PATENT AND TRADEMARK OFFICE

CERTIFICATE OF CORRECTION

PATENT NO. : 6,254,205 B1
DATED : July 3, 2001
INVENTOR(S) : Alan R. Wright et al.

It is certified that error appears in the above-identified patent and that said Letters Patent is hereby corrected as shown below:

Column 12,
Line 10, delete "selectively movable between an open position and a closed position in response to movement of said telescopic rail with respect to said cabinet rail, said homing device"
Line 26, after "rail" insert -- with --
Line 34, after "pin" insert -- extending --
Line 40, delete "locking slide" and insert -- homing device --

Signed and Sealed this

Twentieth Day of May, 2003

JAMES E. ROGAN
*Director of the United States Patent and Trademark Office*